United States Patent [19]

Tsou

[11] Patent Number: 4,475,588

[45] Date of Patent: Oct. 9, 1984

[54] HEAT EXCHANGER WITH TUBES FIXED AT BAFFLES

[75] Inventor: John L. Tsou, Berlin, Wis.

[73] Assignee: McQuay Inc., Minneapolis, Minn.

[21] Appl. No.: 306,242

[22] Filed: Sep. 28, 1981

[51] Int. Cl.[3] ..... F28F 9/00

[52] U.S. Cl. ..... 165/159; 165/162

[58] Field of Search ..... 165/159, 161, 162, 173, 165/178; 248/68 R, 68 CB; 403/187, 238; 285/192, 137 R

[56] References Cited

U.S. PATENT DOCUMENTS

| | | | |
|---|---|---|---|
| 2,018,037 | 10/1935 | Sieder | 165/82 |
| 2,534,690 | 12/1950 | Young, Jr. et al. | 248/68 CB |
| 2,643,862 | 6/1953 | Stelling | 165/161 |
| 2,811,337 | 10/1957 | Andersen | 165/158 |
| 2,876,975 | 3/1959 | Short | 248/58 |
| 3,045,981 | 7/1962 | Hendrickson | 165/82 |
| 3,406,752 | 10/1968 | Lion | 165/173 |
| 3,863,713 | 2/1975 | Tramontini | 165/158 |
| 3,964,146 | 6/1976 | Vestre et al. | 165/162 |
| 4,114,684 | 9/1978 | Jenis et al. | 165/82 |
| 4,183,401 | 1/1980 | Bell, Jr. et al. | 165/159 |
| 4,184,862 | 1/1980 | Waters | 248/68 R |
| 4,373,580 | 2/1983 | Gossalter | 165/173 |

*Primary Examiner*—William R. Cline
*Assistant Examiner*—Edward P. Walker
*Attorney, Agent, or Firm*—Merchant, Gould, Smith, Edell, Welter & Schmidt

[57] ABSTRACT

A shell and tube type heat exchanger having one or more intermediate baffles through which the tubes pass, with the tubes being secured at the baffles to prevent or reduce the probability of potentially damaging vibrations. Each baffle comprises a plurality of parallel plates placed closely adjacent each other or sandwiched together and having clearance holes through which the tubes pass. Individual plates of a baffle are offset in different directions and secured in the offset position to secure the tubes by the opposing engagement of the edges of their clearance holes.

4 Claims, 7 Drawing Figures

HEAT EXCHANGER WITH TUBES FIXED AT BAFFLES

FIELD OF THE INVENTION

This invention relates to improvements in shell and tube type heat exchangers, and specifically to an improvement directed to securing or fixing the tubes at the baffles of the heat exchanger.

BACKGROUND OF THE INVENTION

Shell and tube type heat exchangers are widely used in a variety of industries in various applications for the heating or cooling of fluids. Basically a shell and tube type heat exchanger consists of a plurality of generally parallel tubes arranged in a bundle and placed within a shell. One fluid is circulated through the tubes while a second fluid circulates within the shell, over and around the tubes to establish heat transfer between the two fluids. End plates or other means are provided to physically keep the fluids separate, and appropriate connections are provided for conveying the fluids to and form the heat exchanger. Baffles are usually provided to direct the flow within the shell in several passes across the tubes to increase heat transfer. The baffles generally comprise plates that extend partially, but not completely, across the inside of the shell, with tubes passing through clearance holes in the baffles. The baffles perform the function of supporting the tubes at one or more intermediate points in their span from one end of the heat exchanger to the other, as well as serving to direct the flow of fluid within the shell in the desired path back and forth across the tubes.

It has long been recognized that care must be taken in the design and construction of heat exchangers to avoid the potentially damaging effects of vibration. Such vibration can be induced by flow conditions within the heat exchangers, or can be caused by vibration sources external to the heat exchanger, or a combination of both. Whatever the cause of the vibration, the greatest difficulty occurs when the frequency of vibrations coincides with, or falls within the same range as, the natural resonant vibration frequency of the tubes. If the internally induced or externally excited vibrations approach too closely to the resonant frequency of the tubes, severe vibration and damage can result. It is therefore necessary in the design of such heat exchangers to separate the natural frequency of the tubes by a safe margin from the frequency of the vibration to which the heat exchanger will be subjected during use.

In prior art multiple span baffled shell and tube heat exchanger the tubes are supported by the baffles, but are not entirely fixed. In order to facilitate manufacture and assembly, the holes in the baffle are drilled slightly larger than the outside diameter of tubes. The resulting structure allows a small amount of lateral movement of the tubes within the baffles. This arrangement of tubes and baffles may be mathematically modeled as beams simply supported at each intermediate baffle. The natural frequency of the tubes calculated in this manner is very close to the measured value.

In order to alter the natural frequency of the tubes for a particular heat exchanger design application, it may be possible to change the number or spacing of the baffles thereby to change the unsupported tube span. However, it may not be possible to change the tube span and baffle position due to heat transfer or pressure drop design requirements for the heat exchanger.

The present invention provides a method for fixing, as opposed to simply supporting, the tubes at the baffles, which increases the natural frequency of the tubes by a considerable amount without affecting other design and performance criteria for the heat exchanger. At the same time the fixing of the tubes at the baffles eliminates the small clearance between baffle and tube existing in prior heat exchangers referred to above, and eliminates impact damage between the tubes and baffles in the event that vibration problems do occur.

SUMMARY OF THE INVENTION

According to this invention there is provided an improved shell and tube type heat exchanger with means for fixing the tubes at the baffles. The heat exchanger includes a shell, a plurality of heat exchange tubes, and means supporting the tubes in generally parallel relationship to one another within the shell to form a flow path for a first fluid within the tubes and a flow path for a second fluid within the shell around, and in heat exchange relationship with, the tubes. One or more baffles are provided and extend partially across the interior space of the shell, with individual tubes passing through apertures in the baffles. The baffles are formed of two or more planar members positioned together and having corresponding apertures which define the clearance apertures for the tubes which pass therethrough. The individual plates or members of each baffle are laterally offset in opposite directions in the plane of the baffle to contact the tubes along different portions of their surfaces to secure the tubes at the baffles. The individual planar members are then secured in the offset position, as by welding for example, so that the tubes remain fixedly secured at their junctions with the baffles.

DETAILED DESCRIPTION OF THE PREFERRED EMBODIMENT

Figure 1:
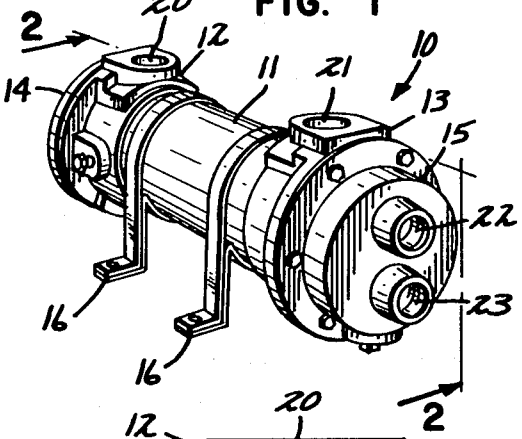
FIG. 1 is a perspective view of a shell and tube type heat exchanger in which the present invention may be used.
Figure 3:
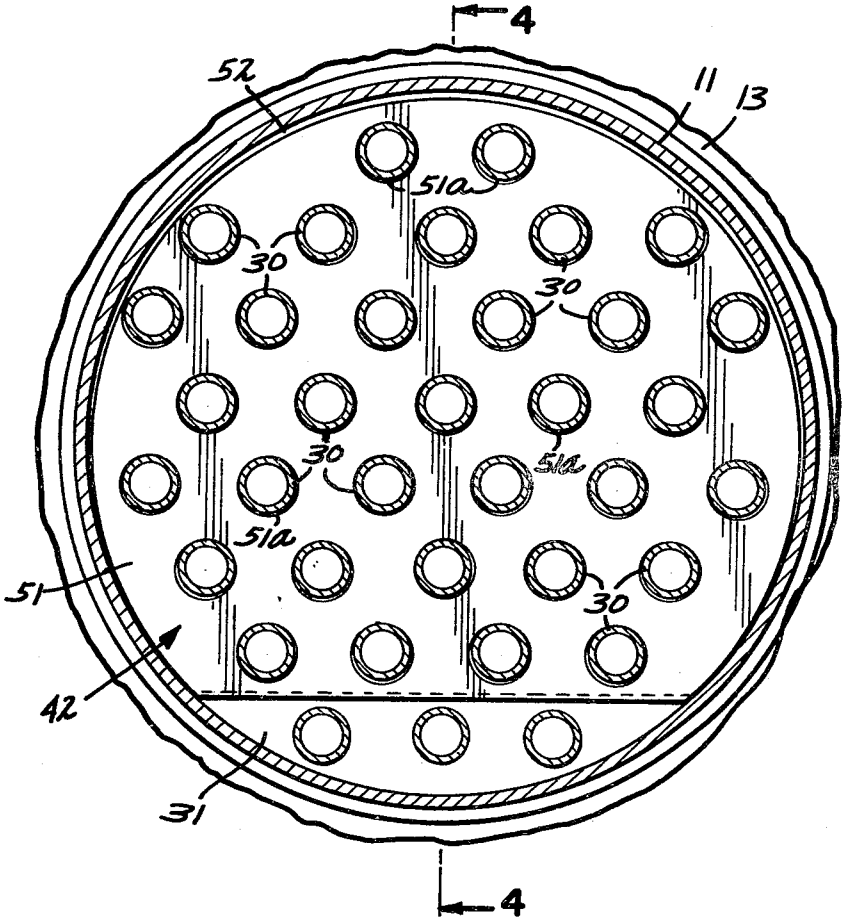
FIG. 3 is a transverse cross-sectional view of the heat exchanger of FIG. 1 as seen generally along line 3—3 of FIG. 2.

Referring to the drawings, like reference numerals designate identical or corresponding parts throughout the several views. In FIG. 1, reference number 10 generally designates a shell and tube heat exchanger in which the present invention might be used. Heat exchanger 10 includes a shell 11 which is preferrably of seamless tubing. End castings 12 and 13, which may be made of cast iron, are brazed to the ends of shell 11. Cast iron end bonnets 14 and 15 are bolted to flanges in the end castings 12 and 13, respectively, it being understood that suitable gaskets are provided as are known in the art. If desired, mounting brackets 16 may be provided to mount the heat exchanger in use. Fittings or connections 20 and 21 are provided in end castings 12 and 13, respectively, for providing fluid flow through shell 11. Fittings or connections 22 and 23 are provided in end bonnet 15 for providing fluid flow through the tubes. It will be understood that fittings or connections 22, 23 might be in opposite end bonnets, depending upon whether the heat exchanger is a single or multiple pass unit, as is generally known in the art.

Figure 5:
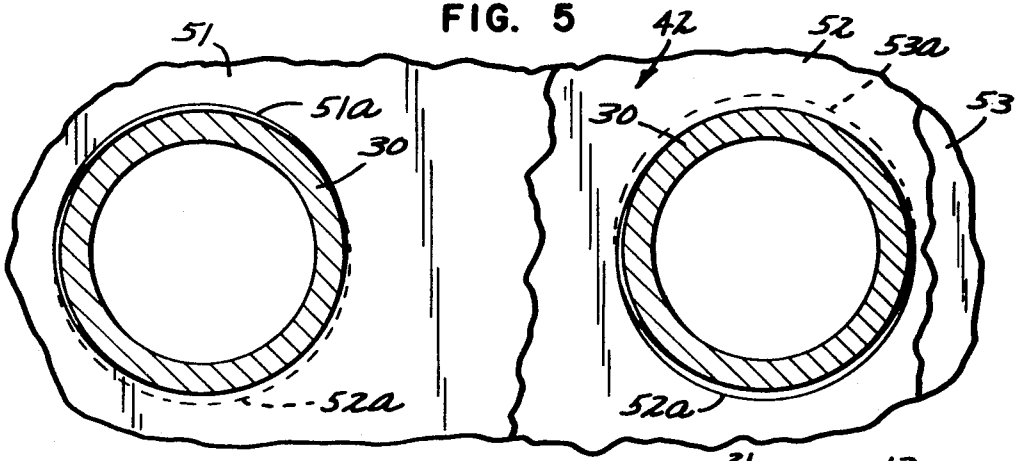
FIG. 5 is a view of a portion of the baffle of FIG. 3 including two adjacent tubes, at an enlarged scale, portions thereof being broken away for illustrative purposes.
Figure 2:
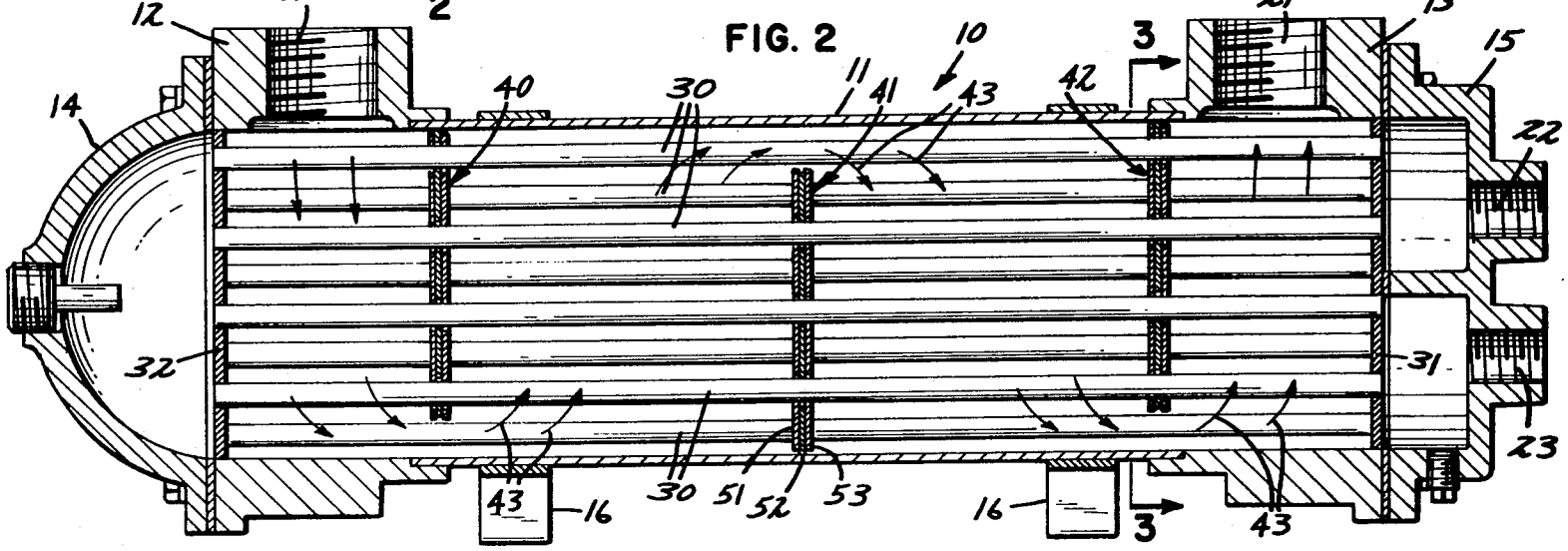
FIG. 2 is a cross-sectional view of the heat exchanger of FIG. 1, as seen along line 2—2 thereof.

As seen in FIG. 2, a plurality of tubes 30 are provided. The tubes, which are preferrably made of seamless copper tubing, are held in parallel spaced relationship by tube sheets 31 and 32 to form the tube bundle. The ends of the tubes pass through apertures in tube sheets 31 and 32 and are secured thereby by suitable means, for example silver soldering. The end bonnets define chambers to permit fluid communication to and from external fittings or for directing flow from one set of tubes to the other, as is generally known.

One or more baffles are provided within the heat exchanger, and in the embodiment shown, three baffles indicated by reference numbers 40, 41 and 42 are shown. The baffles are planer members that are generally circular but which have a short or truncated side. The baffles extend transversely within the shell from side to side, but not entirely across the shell so as to leave room for fluid to flow around the short or truncated end. The baffles have openings to allow tubes 30 to pass therethrough. It will be understood that any number of baffles can be used depending upon the application, and they are spaced at intervals and alternated with respect to the orientation of their short or truncated sides, to form a serpentine flow path for the fluid within the shell, as indicated by the flow arrows 43 of FIG. 2. The baffles effectively seal fluid flow around the periphery of the baffle where it joins the shell, forcing fluid flow back and forth across the tubes between successive baffles.

Figure 4:
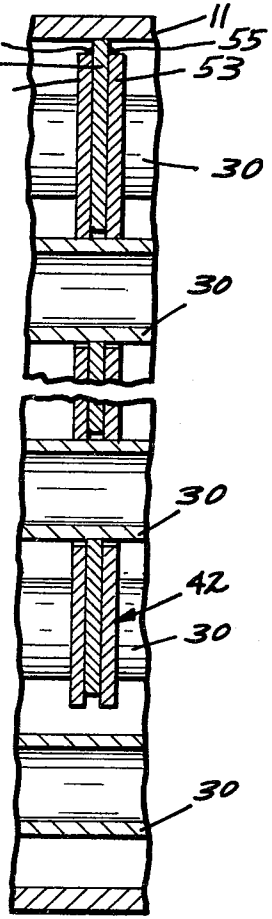
FIG. 4 is an enlarged fragmentary view of the baffle and tube arrangement of the present invention, as seen generally along line 4—4 of FIG. 3.

Each of the baffles is made up of a plurality of planar members or plates. The plates are closely adjacent or in contact with one another in parallel, stacked, face-to-face orientation to form an individual baffle. In the embodiment shown, each baffle is made of three plates. See for example FIG. 4, which shows baffle 42 composed of plates 51, 52 and 53 positioned together. Each baffle plate includes an array of clearance holes for receiving the individual tubes of the tube bundle, and the clearance holes of the individual plates 51, 52 and 53 are cooperatively placed to provide the pass-through apertures for the individual tubes of the tube bundle.

Figure 6:
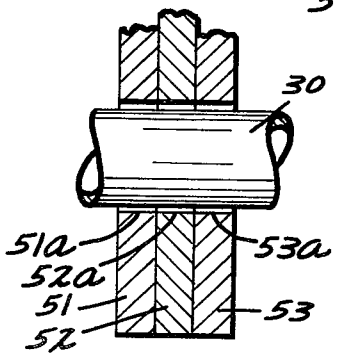
FIGS. 6 and 7 are sectional views showing the relationship between the tubes and the apertures of a baffle.
Figure 7:
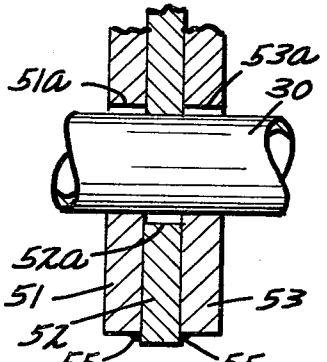

The clearance holes are larger than the outside diameter of the tubes so as to facilitate assembly during the manufacturing process. This can be seen in FIG. 6, which shows an elongated view of a stack of three baffle plates 51, 52 and 53 for one of the baffles. The plates are positioned together, with a individual tube 30 passing through the aperture thus formed by the clearance holes 51*a*, 52*a*, 53*a* respectively of the plates. It will be appreciated that the amount of clearance in excess of the diameter of the tube is somewhat exaggerated in FIG. 6 for purposes of clarity. During assembly, the tubes of the tube bundle are placed through the generally aligned clearance holes 51*a*, 52*a*, 53*a* in the baffle plates. Subsequently, the baffle plates are laterally offset with respect to each other as indicated in FIG. 7, then tack welded in place at various points around the periphery, as at reference number 55. In offsetting the baffle plates, they are moved parallel to their planes but in differing directions so as to engage and capture the tube along different portions of its outer wall. In FIG. 7, plates 51 and 53 engage the tube 30 along the bottom portion (in the orientation of the figure) while plate 52 engages the tube around the top portion. The net result is to capture and fix the tube securely at the baffle. At the same time the adjacent plates close off each other's excess clearance due to the offset.

The resulting structure maintains the ease of assembly of the prior art but, unlike the prior art which only simply supports the tubes at the baffles, the improved structure herein fixes the tubes securely at the baffles. The result is an increase in the resonant or natural frequency of the tube bundles, in some cases of up to 230 percent. At the same time the clearance between the baffle and the tube is essentially eliminated, eliminating the possibility of impact damage in the event that vibration should occur.

It will be appreciated that while three plates are shown as making up a baffle, two plates or a greater number of plates could also be used. Also, any convenient means for securing the plates in the offset position can be used. While three baffles are shown in the heat exchanger of the drawings herein, any number of baffles can be provided according to the performance requirements for the heat exchanger, and in accordance with considerations discussed above for control of the natural frequency of the tube bundle.

It will thus be seen that the invention provides an improved shell and tube heat exchanger construction, which provides for securing the tubes at the baffles for control of the natural frequency thereof and for the elimination of vibration induced impact damage, while still permitting ease of assembly.

What is claimed is:

1. A heat exchanger comprising:

a shell;

a plurality of heat exchange tubes positioned within the shell;

means connected to the end portions of said tubes and to said shell, respectively, to form a flow path for one fluid within the tubes, and a flow path for another fluid within the shell in heat exchange relationship with the fluid in the tubes;

at least one baffle positioned in said shell at an intermediate position along said tubes with said tubes passing therethrough, said baffle comprising at least three rigid plates positioned together in stacked relationship, said plates having corresponding clearance holes through which the tubes pass, sized to permit insertion of the tubes during assembly; and means securing said plates with their corresponding clearance holes laterally offset so that the edges thereof engage different portions of the outer surface of the tubes.

2. A heat exchanger comprising:

a shell;

a plurality of heat exchange tubes and means positioning them in generally parallel relationship to form a tube bundle within said shell;

means for connecting to the end portions of said tubes and to said shell, respectively, to form a flow path for one fluid within the tubes, and a flow path for another fluid within the shell in heat exchange relationship with the fluid in the tubes;

a plurality of baffles positioned in said shell transverse to said tubes at intermediate positions therealong with the tubes passing through apertures in said baffles;

said baffles each comprising at least three rigid baffle plates positioned together in stacked relationship, each baffle plate having an array of clearance holes for receiving the individual tubes of said tube bundle; and means for holding adjacent baffle plates offset in different directions in their respective planes to secure the tubes by the opposing engagement of the edges of their clearance holes.

3. A heat exchanger according to claim 2 in which each baffle comprises three baffle plates sandwiched together, with the middle plate offset in the opposite direction from the outer plates.

4. A heat exchanger according to claim 2 in which said baffle plates are welded together in said offset position.

* * * * *